US009174428B2

(12) United States Patent
Boudreau et al.

(10) Patent No.: US 9,174,428 B2
(45) Date of Patent: Nov. 3, 2015

(54) ROLL MECHANICS FOR ENABLING PRINTED ELECTRONICS

(75) Inventors: Robert Addison Boudreau, Corning, NY (US); Douglas Edward Brackley, Horseheads, NY (US); Raymond Charles Cady, Horseheads, NY (US); Gary Edward Merz, Rochester, NY (US); James Paul Peris, Horseheads, NY (US); Kevin Lee Wasson, Elmira, NY (US)

(73) Assignee: Corning Incorporated, Corning, NY (US)

( * ) Notice: Subject to any disclaimer, the term of this patent is extended or adjusted under 35 U.S.C. 154(b) by 924 days.

(21) Appl. No.: 12/538,589

(22) Filed: Aug. 10, 2009

(65) Prior Publication Data

US 2011/0030569 A1 Feb. 10, 2011

(51) Int. Cl.

| | |
|---|---|
| ***B41F 5/00*** | (2006.01) |
| ***B41F 5/18*** | (2006.01) |
| ***B41F 9/00*** | (2006.01) |
| ***B41C 1/05*** | (2006.01) |
| ***B41F 13/21*** | (2006.01) |
| ***B41C 1/04*** | (2006.01) |
| ***B41F 13/22*** | (2006.01) |

(52) U.S. Cl.

CPC . *B41F 9/003* (2013.01); *B41C 1/04* (2013.01); *B41C 1/05* (2013.01); *B41F 13/21* (2013.01); *B41F 13/22* (2013.01); *B41P 2227/70* (2013.01)

(58) Field of Classification Search

CPC ..... B41F 13/21; B41F 9/003; B41F 13/22; B41C 1/04; B41C 1/05; B41P 2227/70

USPC ..... 101/365, 479, 480, 483, 484; 219/121.68

See application file for complete search history.

(56) References Cited

U.S. PATENT DOCUMENTS

| | | | | |
|---|---|---|---|---|
| 3,725,950 | A * | 4/1973 | Lamb | 347/145 |
| 3,847,079 | A * | 11/1974 | Dahlgren | 101/490 |
| 4,419,831 | A | 12/1983 | Zimmer | 33/181 |
| 4,484,522 | A * | 11/1984 | Simeth | 101/248 |
| 4,502,384 | A | 3/1985 | Habluetzel | 101/153 |
| 4,929,073 | A | 5/1990 | La Plante et al. | 350/609 |
| 5,075,980 | A | 12/1991 | Kerman | 33/618 |
| 5,317,971 | A | 6/1994 | Deye, Jr. et al. | 101/486 |
| 5,335,595 | A | 8/1994 | Yamashita et al. | 101/158 |
| 5,492,057 | A * | 2/1996 | Bornhors et al. | 358/3.32 |

(Continued)

FOREIGN PATENT DOCUMENTS

| | | |
|---|---|---|
| CN | 2847796 | 12/2006 |
| JP | 57-193366 | 11/1982 |

(Continued)

OTHER PUBLICATIONS

TIPO Domestic and External Patent Database, EPO, USPTO & JPO Search report, dated Nov. 6, 2014.

*Primary Examiner* — Blake A Tankersley
*Assistant Examiner* — Marissa Ferguson Samreth
(74) *Attorney, Agent, or Firm* — Jeffrey A. Schmidt

(57) ABSTRACT

A print press system and a method are described herein that print an electronic circuit onto a material (e.g., glass substrate, plastic film, plastic film-glass substrate laminate). In exemplary applications, the print press system can print an electronic circuit onto a material to form, for instance, a flexible Liquid Crystal Display, a retail point of purchase sign and an e-book.

10 Claims, 5 Drawing Sheets

(56) References Cited

U.S. PATENT DOCUMENTS

| | | | | |
|---|---|---|---|---|
| 5,636,573 | A | 6/1997 | Brennan | 101/486 |
| 5,748,827 | A | 5/1998 | Holl et al. | 385/134 |
| 5,937,149 | A * | 8/1999 | Lindner et al. | 358/1.14 |
| 6,176,287 | B1 * | 1/2001 | Weber | 156/555 |
| 6,199,480 | B1 * | 3/2001 | Leonhardt et al. | 101/248 |
| 6,325,351 | B1 | 12/2001 | Hale et al. | 248/562 |
| 6,525,839 | B1 * | 2/2003 | Beckett et al. | 358/3.31 |
| 6,668,717 | B2 * | 12/2003 | Schneider et al. | 101/182 |
| 6,746,172 | B2 * | 6/2004 | Culpepper | 403/13 |
| 7,047,880 | B2 * | 5/2006 | Ishimoto et al. | 101/170 |
| 7,253,929 | B2 | 8/2007 | Wendel | 358/474 |
| 7,281,475 | B2 | 10/2007 | Kot | 101/486 |
| 7,392,741 | B2 | 7/2008 | Maggio | 101/216 |
| 7,392,742 | B2 | 7/2008 | Schaschek et al. | 101/218 |
| 7,398,730 | B2 | 7/2008 | Schrauwers | 101/216 |
| 7,400,850 | B2 | 7/2008 | Romem | 399/296 |
| 7,401,553 | B2 | 7/2008 | Glunz et al. | 101/477 |
| 7,421,948 | B2 * | 9/2008 | Schneider et al. | 101/487 |
| 7,691,294 | B2 | 4/2010 | Chung et al. | 252/500 |
| 8,432,428 | B2 * | 4/2013 | Moisa et al. | 347/262 |
| 2006/0254440 | A1 | 11/2006 | Choi et al. | |
| 2008/0141886 | A1 * | 6/2008 | Whitelaw et al. | 101/484 |
| 2009/0288567 | A1 | 11/2009 | Choi et al. | 101/154 |

FOREIGN PATENT DOCUMENTS

| | | |
|---|---|---|
| JP | 2510023 | 11/1991 |
| JP | 05-138872 | 6/1993 |
| JP | 7-266535 | 10/1995 |
| JP | 09-248895 | 9/1997 |
| JP | 2005109296 | 4/2005 |
| JP | 2005-225064 | 8/2005 |
| JP | 2006-289983 A | 10/2006 |
| KR | 10-2009-0036728 | 4/2009 |
| TW | 349477 | 1/1999 |

* cited by examiner

ROLL MECHANICS FOR ENABLING PRINTED ELECTRONICS

TECHNICAL FIELD

The present invention relates in general to a print press system and a method for printing an electronic circuit on a material (e.g., glass substrate, plastic film, and plastic film-glass substrate laminate). In exemplary applications, the print press system can print an electronic circuit on a material to form, for instance, a flexible Liquid Crystal Display, a retail point of purchase sign and an e-book.

BACKGROUND

Manufacturers have been trying to improve the performance of the current printing technology to enable electronic circuits with small features to be printed on a piece of material. In particular, manufacturers would like to improve the current printing technology which uses a sequence of print cylinder stations to enable higher resolution and higher precision for layer to layer registration so that electronic circuits with small features can be effectively printed onto a material. For instance, the current printing technology which uses print cylinder stations can print features onto a material with a layer to layer registration of approximately ±125 μm. Thus, any enhancement in the current printing technology would be desirable to help improve the printing of electronic circuits with small features onto a material.

SUMMARY

In one aspect, the present invention provides a print cylinder station for printing at least part of an electronic circuit on a material. The print cylinder station includes: (a) a base; (b) a plurality of adjustable mounts located on the base; (c) at least one component, where each component (e.g., roller support platform, doctor blade system) is located on one or more of the adjustable mounts; (d) a pair of bearings, where each bearing is located on one or more of the adjustable mounts; and (e) a print cylinder rotatably supported between the pair of bearings, where the one or more of the adjustable mounts associated with the pair of bearings and the one or more of the adjustable mounts associated with each component have been positioned to ensure that each component is substantially aligned with the print cylinder. In addition, the print cylinder station may include a pressure cylinder, a temperature control system, a pressure sensor, a print cylinder registration sensor, and a material registration sensor.

In another aspect, the present invention provides a print press system for printing an electronic circuit on a material. The print press system includes a main control system which operatively controls a lead print cylinder station and at least one subsequent print cylinder station. The lead print cylinder station and subsequent print cylinder station(s) are aligned next to one another such that the material is able to be transported from the lead print cylinder station to each of the subsequent print cylinder station(s) while the electronic circuit is printed on the material. Each print cylinder station includes: (a) a base; (b) a plurality of adjustable mounts located on the base; (c) at least one component, where each component (e.g., roller support platform, doctor blade system) is located on one or more of the adjustable mounts; (d) a pair of bearings, where each bearing is located on one or more of the adjustable mounts; and (e) a print cylinder rotatably supported between the pair of bearings, where the one or more of the adjustable mounts associated with the pair of bearings and the one or more of the adjustable mounts associated with each component have been positioned to ensure that each component is substantially aligned with the print cylinder. In addition, each print cylinder station may include a pressure cylinder, a temperature control system, a pressure sensor, a print cylinder registration sensor, and a material registration sensor.

In yet another aspect, the present invention provides a method for printing an electronic circuit on a material. The method including the steps of: (a) setting-up a lead print cylinder station and at least one subsequent print cylinder station; and (b) aligning the lead print cylinder station and the subsequent print cylinder station(s) next to one another such that the material is able to move from the lead print cylinder station to each of the subsequent print cylinder(s) while the electronic circuit is printed on the material. Each print cylinder station includes: (a) a base; (b) a plurality of adjustable mounts located on the base; (c) at least one component, where each component (e.g., roller support platform, doctor blade system) is located on one or more of the adjustable mounts; (d) a pair of bearings, where each bearing is located on one or more of the adjustable mounts; and (e) a print cylinder rotatably supported between the pair of bearings, where the one or more of the adjustable mounts associated with the pair of bearings and the one or more of the adjustable mounts associated with each component have been positioned to ensure that each component is substantially aligned with the print cylinder. In addition, each print cylinder station may include a pressure cylinder, a temperature control system, a pressure sensor, a print cylinder registration sensor, and a material registration sensor.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be had by reference to the following detailed description when taken in conjunction with the accompanying drawings wherein.

DETAILED DESCRIPTION

Figure 1:
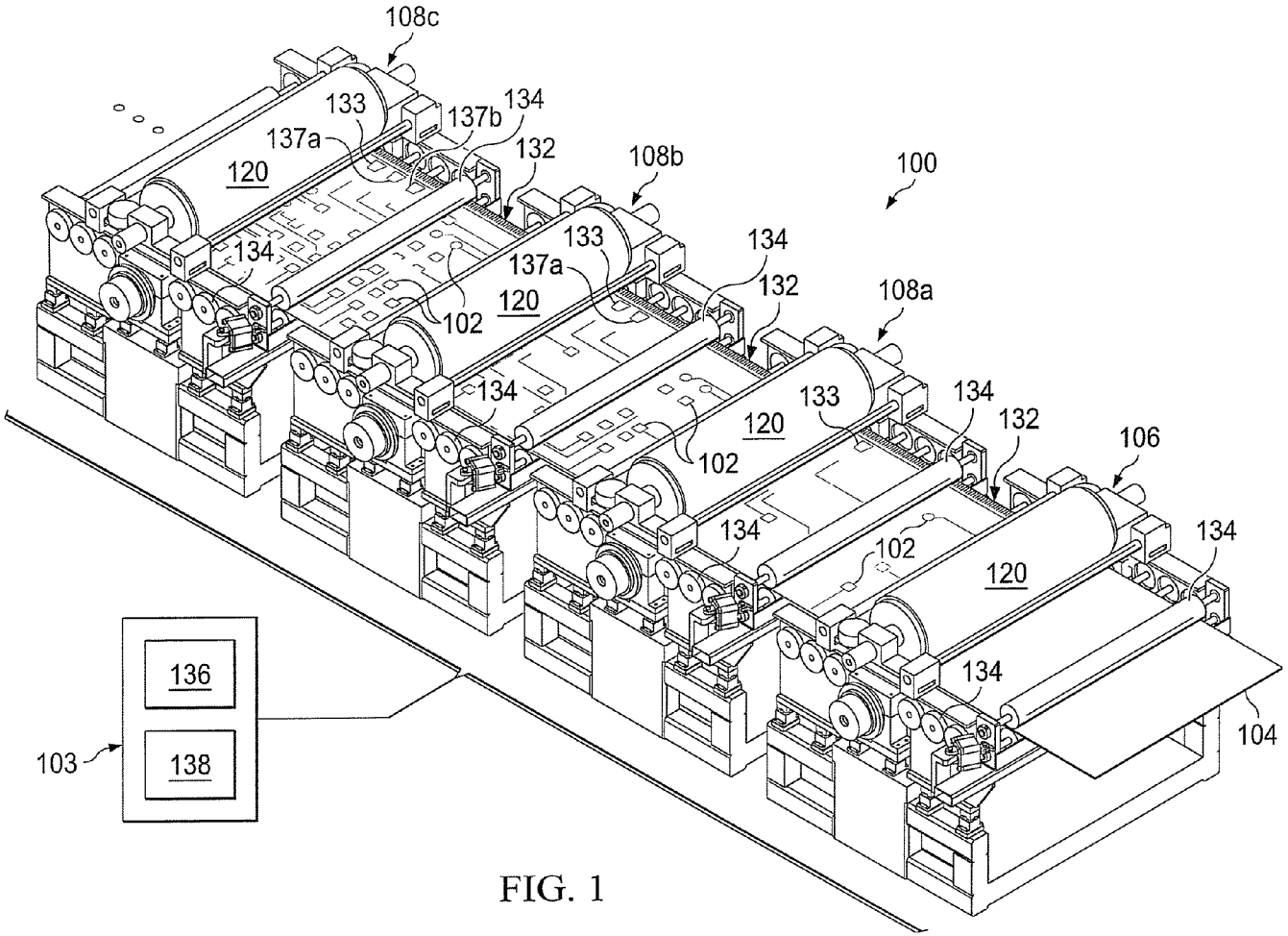
FIG. 1 is a perspective view of an exemplary print press system for printing an electronic circuit on a material in accordance with an embodiment of the present invention.

Referring to FIG. 1, there is a perspective view of an exemplary print press system 100 for printing an electronic circuit 102 on a material 104 in accordance with an embodiment of the present invention. The exemplary print press system 100 includes a closed-loop main control system 103, a lead print cylinder station 106, and one or more subsequent print cylinder stations 108*a*, 108*b* and 108*c* (only three shown). The lead print cylinder station 106 and subsequent print cylinder stations 108*a*, 108*b* and 108*c* are aligned (e.g., laser aligned) and placed next to one another such that the material 104 can be transported from the lead print cylinder station 106 to each of the subsequent print cylinders stations 108*a*, 108*b* and 108*c* while their respective print cylinders 118 print at least a portion of the electronic circuit 102 onto the material 104. In this case, the electronic circuit 102 is printed on a bottom side of the material 104 (which in this example the material 104 is transparent).

In operation, the lead print cylinder station 106 prints a portion of the electronic circuit 102 on the bottom side of the bare material 104. The first subsequent print cylinder station 108*a* then prints another portion of the electronic circuit 102 over or adjacent to the first portion of the electronic circuit 102. The second subsequent print cylinder station 108*b* then prints another portion over or adjacent to the two previous portions of the electronic circuit 102. The third subsequent print cylinder station 108*c* prints another portion over or adjacent to the three previous portions to form the electronic circuit 102. In this example, the electronic circuit 102 is printed on the bottom surface of the material 104 which can be a glass substrate 104, a plastic film 104, or a plastic film-glass substrate laminate 104. For clarity, a description about well known components such as, for example, tension systems, drying systems, inspection systems, take-up systems have not been discussed herein.

Figure 2:
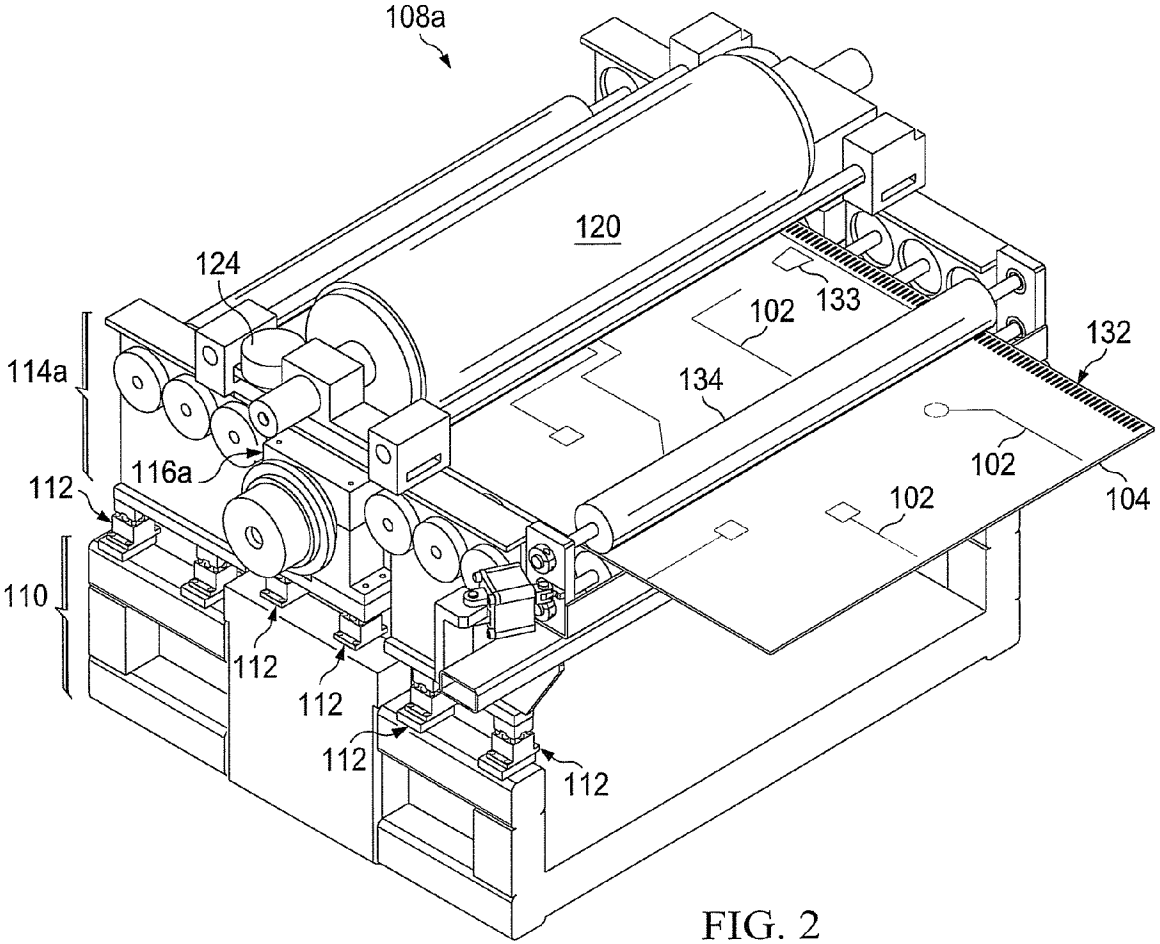
FIG. 2 is a perspective view of one of the print cylinder stations shown in FIG. 1.
Figure 3:
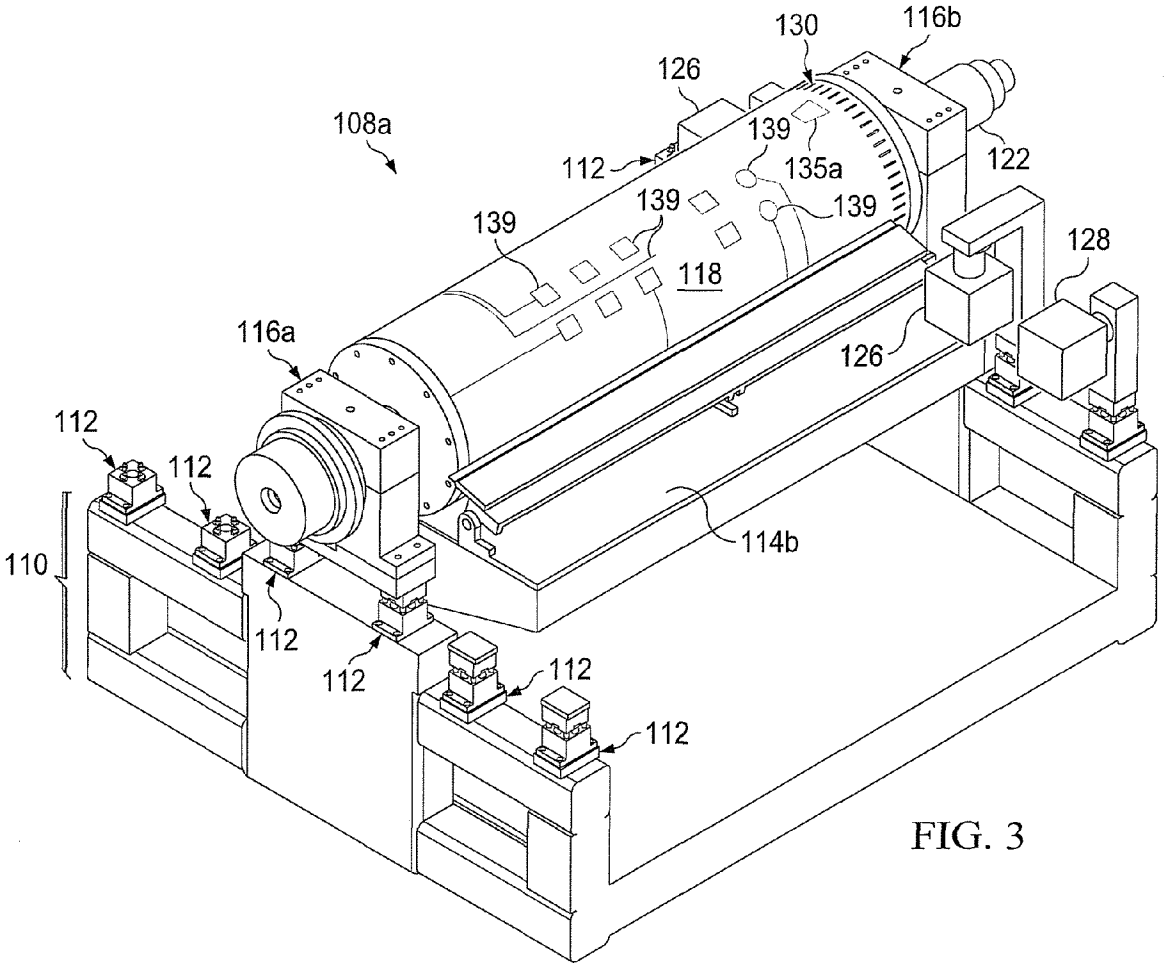
FIG. 3 is a perspective view of the print cylinder station shown in FIG. 2 where the material, a roller support platform, a pressure cylinder and a pressure (force) sensor have been removed therefrom to illustrate a print cylinder, doctor blade system and a temperature control system.

Referring to FIGS. 2 and 3, there are two perspective views of an exemplary print cylinder station 108*a* (for example) used in the print press system 100. The exemplary print cylinder station 108*a* includes a base 110, multiple adjustable mounts 112 (e.g., kinematic mounts 112, exact constraint mounting features 112), various components 114 (e.g., roller support platform 114*a*, doctor blade system 114*b*), bearings 116*a* and 116*b*, a print cylinder 118, a pressure cylinder 120, a temperature control system 122, a pressure sensor 124, a print cylinder registration sensor 126, and a material registration sensor 128. FIG. 3 illustrates the print cylinder station 108*a* with the material 104, the roller support platform 114*a*, the pressure cylinder 120 and the pressure sensor 124 removed therefrom so that one can see the print cylinder 118, the doctor blade system 124, the temperature control system 122, the print cylinder registration sensor 126, and the material registration sensor 128.

In this example, the print cylinder stations 106, 108*a*, 108*b* and 108*c* each have their own base 110 on which there is located multiple kinematic mounts 112 (e.g., exact constraint mounting features 112). Each component 114 (e.g., roller support platform 114*a*, doctor blade system 114*b*) is located on top of one or more of the multiple kinematic mounts 112. Each bearing 116*a* and 116*b* is located on top of one or more of the multiple kinematic mounts 112. The print cylinder 118 is rotatably supported between the pair of bearings 116*a* and 116*b*. The kinematic mounts 112 have been adjusted and positioned to ensure that each component 114 is substantially aligned with the print cylinder 118. The pressure cylinder 120 is positioned above the print cylinder 118 so the material 104 can be drawn there between while printing at least a portion of the electronic circuit 102 on the material 104. The temperature control system 122 is adapted to circulate a media within the print cylinder 118 to control a temperature of the print cylinder 118. The pressure sensor 124 is adapted to monitor a force (nip force) applied by the print cylinder 118 and the pressure cylinder 120 onto the material 104 while at least part of the electronic circuit 102 is printed on the material 104. The print cylinder registration sensor 126 can be an optical sensor that is adapted to respectively monitor registration lines 130 engraved on the print cylinder 118. The material registration sensor 128 can be an optical sensor that is adapted to monitor registration lines 132 and trapezoid(s) 133, 137*a*, 137*b* (or any shape that has an angled edge) printed on the material 104.

In this example, the print cylinder 118 of lead print cylinder station 106 has engraved registration lines (not shown) and an engraved trapezoid (not shown) that respectively print the registration lines 132 and the registration trapezoid 133 on the material 104 (see FIG. 1). The lead print cylinder station 106 would not necessarily have a need for the material registration sensor 128. The subsequent print cylinder stations 108*a*, 108*b* and 108*c* also have print cylinders 118 with engraved registration lines 132, but these would not need to print registration lines onto the material 104. The subsequent print cylinder stations 108*a*, 108*b* and 108*c* would have print cylinders 118 each with a specific engraved trapezoid 135*a* (only one shown) that print a specific registration trapezoid 137*a* or 137*b* (only two shown) onto the material 104 (see FIGS. 1 and 3). In this case, the print cylinder station 108*a* with the print cylinder 118 having the engraved trapezoid 135*a* would print the registration trapezoid 137*a* on the material 104. The print cylinder station 108*b* with the print cylinder 118 having an engraved trapezoid (not shown) would print the registration trapezoid 137*b* on the material 104. In addition, the print cylinders 118 would all have their own distinctive engraved circuit lines 139 located thereon which are used to print at least a portion of the electronic circuit 102 onto the material 104 (see FIG. 3). A detailed discussion about the aforementioned exemplary elements 112, 114*a*, 114*b*, 116*a*, 116*b*, 118, 120, 122, 124, 126, 128, 130, 132, 133, 135 and 137 is provided next.

The print cylinder stations 106, 108*a*, 108*b* and 108*d* (for example) starting with the print cylinder's bearings 116*a* and 116*b* and working outward may be constructed as described below.

Print Cylinder's Bearings 116*a* and 116*b*

The print cylinder 118 may be radially supported by a pair of air or hydrostatic bearings 116*a* and 116*b* to achieve minimal run-out and maximum performance of the print cylinder 118. The air or hydrostatic bearings 116*a* and 116*b* offer a lower run-out and higher stiffness when compare to lower grade bearings, thus resulting in greater performance. In particular, with the lower run-out, the features of the circuit 102 can be printed more accurately on the material 104 and a better layer to layer registration of the different layers of the electronic circuit 102 on the material 104 can be achieved by the print cylinder stations 106, 108*a*, 108*b*, and 108*b*. Plus, with the higher stiffness, the forces applied when transferring a printed image for the electronic circuit 102 from the print cylinder 118 to the material 104 would have less impact on the print cylinder 118 and the bearings 116*a* and 116*b*. It is estimated that the run-out can be improved from 10 um to less than 1 um and the stiffness can be improved from 175,000 n/mm to 525,000 n/mm by utilizing the air or hydrostatic bearings 116*a* and 116*b*. If desired, the pressure cylinders 120 may also be mounted with a pair of air or hydrostatic bearings which can help improve the consistency of the nip force with the print cylinders 118 and therefore help improve the transfer of the ink to the material 104. Some examples of different types of ink that can be used include conductive inks (both silver based and clear conductors, such as PEDOT:PSS), dielectric inks (i.e., PVP, PMMA) and semi-conductive (Lisicon™) inks.

Kinematic Mounts 112

The kinematic mounts 112 may be used to support and accurately locate the print cylinder 118 (located on the bearings 116*a* and 116*b*) and the various components 114 including, for instance, the roller support platform 114*a* and the doctor blade system 114*b*. The kinematic mounts 112 maintain a precise level tolerance alignment with high performance repeatability when locating and supporting the print cylinder 118, the roller support platform 114*a*, and the doctor blade system 114*b* to achieve a high level of printing accuracy. In this example, the roller support platform 114*a* can be used to support multiple or various types of rollers 134 (e.g., impression rollers, analox rollers, gravure print rollers, and other rollers), the pressure cylinder 120, the temperature control system 122, the pressure sensor 124, the print cylinder registration sensor 126, the material registration sensor 128, and other associated equipment (see FIGS. 2-3). Thus, by creating a network of the kinematic mounts 112, the roller support platform 114*a*, the doctor blade system 114*b*, and other devices like the conveyor rollers 134, the pressure cylinder 120, the temperature control system 122, the pressure sensor 124, the print cylinder registration sensor 126, and the material registration sensor 128 can be aligned to the print cylinder 118. Since, the kinematic mounts 112 are highly repeatable this means that the components 114*a* and 114*b* and other devices 120, 122, 124, 126, 128, 134 etc. will go back to their original alignment when removed and re-installed. It is estimated that the print cylinder station 106, 108*a*, 108*b*, and 108*c* can be designed and built that will allow for improved component 114*a* and 114*b* and device 120, 122, 124, 126, 128, 134 etc. set-up repeatability from 25 urn to less than 10 um. Exemplary kinematic mounts 112 include ones that are manufactured by EROWA Technology Inc. and Physical Science Laboratory (PSL). The exemplary kinematic mounts 112 which are manufactured by EROWA Technology Inc. have been shown in FIG. 1-3. These kinematic mounts 112 and other types of kinematic mounts 112 or precision mounts 112 are well known to those skilled in the art and as such a detailed discussion about the construction and use of kinematic mounts 112 has not been described herein. For instance, several different types of kinematic mounts that could be used in this particular application have been described in U.S. Pat. Nos. 4,929,073; 5,748,827 and 6,325,351, the contents of these documents are hereby incorporated by reference herein.

Temperature Control System 122

The temperature control system 122 may be used to help minimize the performance impact due to temperature gradients within the system or individual components or temperature fluctuations within the system or individual components during the printing process and thereby maximize performance by heating or cooling the print cylinder 118, the pressure cylinder 120 and/or the other associated rollers 134 to maintain an even temperature distribution throughout the system or components and a constant temperature level throughout the process. For instance, the temperature control system 122 may utilize rotary unions which can be added to the print cylinder 118, the pressure cylinder 120 and/or the other associated rollers 134 so that coolant or heating media can be circulated therein to achieve the desired temperature profile. The temperature control system 122 may also be used to maintain a uniform and constant temperature of a roller 134, to heat a roller 134, to help dry or set an ink, or to cool a roller 134 to lower the temperature of the material 104 prior to printing. In addition, the temperature control system 122 can be used to help maintain a constant temperature of the bearing media within the hydrostatic bearings 116*a* and 116*b*. The main control system 103 may control and monitor the temperature control system 122. It is estimated that the temperature control system 122 can be designed and built to maintain the temperature of the print cylinder 118 to within about 0.3° C. of a desired printing temperature, which for instance (based on the coefficient thermal expansion (CTE) of the print cylinder 118) can maintain a growth of 1 um within an A4 size print pattern. Plus, the temperature control system 122 can be designed and built to minimize a temperature variation of the material 104 as it passes through the multiple print cylinder stations 106, 108*a*, 108*b* and 108*b* by maintaining the temperature variation of the material 104 during the printing process to within about 1.0° C. of the desired printing temperature. In other words, the growth of an A4 glass substrate would be limited to approximately 1 micron by maintaining the temperature within about 1.0° C. Maintaining the print cylinder and material at a constant and uniform temperature minimizes variations in print position and size, providing for more accurate circuit placement, size, shape and registration.

Pressure Sensor 124

The pressure sensor 124 may be used to monitor a force applied by the print cylinder 118 and the pressure cylinder 120 onto the material 104 while at least part of the electronic circuit 102 is printed on the material 104. In this application, the pressure sensor 124 would be installed in a manner that it measures the force applied to the material 104 as it passes through the nip formed by the print cylinder 118 and the pressure cylinder 120. Thus, the main control system 103 can receive active feedback on the amount of pressure and force applied to the material 104 during the printing process. The main control system 103 can use the pressure force measurement to fine tune the gap between the print cylinder 118 and the pressure cylinder 120 so as to maintain a constant nip force. For instance, the main control system 103 may adjust the nip force between the print cylinder 118 and the pressure cylinder 120 by controlling a mechanical device (not shown), such as a screw drive, hydraulic device, or pneumatic device, upon which the bearings for one of the print cylinder 118 or the pressure cylinder 120 are mounted. This nip force control reduces variations in print size and weight caused by variations in print pressure (nip force), resulting in a more consistent and uniform transfer of ink from the print cylinder 118 to the material 104. It is estimated that the main control system 103 and the pressure sensor 124 can control the nip force to a level of 10's of grams within a desired nip/print force, which helps to improve the consistency of the ink lay down thickness on the material 104.

Closed-Loop Control, Registration Lines 132 and Trapezoids 133, 137*a* and 137*b*

To enable an enhanced active alignment capability, the lead print cylinder 118 has registration lines (not shown) and a trapezoid (not shown) engraved thereon which are used to respectively print the registration lines 132 and the registration trapezoid 133 on the bottom side of the material 104. The down-stream print cylinder stations 108*a*, 108*b* and 108*c* may use their respective print cylinder registration sensor 126 to monitor the engraved registration lines 130 on their respective print cylinders 118. In addition, the down-stream print cylinder stations 108*a*, 108*b* and 108*c* may use their respective material registration sensor 128 to monitor the printed registration lines 132 and the printed registration trapezoids 133, 137*a* and 137*b* on the material 104. Then, the main control system 103 may use the monitored registration marks 130, 132 and the monitored registration trapezoids 133, 137*a* and 137*b* to compensate for alignment, radial and/or linear (with web and cross web) misalignments of the material 104 as well as velocity control in each of the print cylinder stations 106, 108*a*, 108*b* and 108*c*.

In one exemplary control scheme, the main control system 103 can use the monitored registration marks 130 and 132 to compensate for misalignments of the material 104 in the direction of the moving web as well as velocity control in each of the print cylinder stations 106, 108*a*, 108*b* and 108*c*. The main control system 103 can use the angled side of the monitored registration trapezoids 133, 137*a* and 137*b* to compensate for misalignments of the material 104 in the cross web direction. In particular, the main control system 103 can use the leading edge of the monitored registration trapezoids 133, 137*a* and 137*b* to determine registration in the direction of conveyance and the distance from the leading to the trailing edge of the monitored registration trapezoids 133, 137*a* and 137*b* is used to determine registration in the across direction. In this way, each of the down-stream print cylinders 118 can be positioned and rotated to match to the moving material 104. In effect, a trapezoid shape or any shape with an angled edge can be printed on the moving material 104 and then the down-stream print cylinder stations 108*a*, 108*b* and 108*c* may implement an imaging system to help control the respective down-stream print cylinders 118 to match the moving material 104. Alternatively, the main control system 103 may use just the monitored registration trapezoids 133, 137*a* and 137*b* to control velocity and compensate for misalignments of the material 104 in the web direction (by using the straight side of the trapezoids 133, 137*a* and 137*b*) and to compensate for misalignments of the material 104 in the cross web direction (by using the angled side of the registration trapezoids 133, 137*a* and 137*b*). It is estimated by implementing this type of control scheme or a similar control scheme that the active alignment of the print cylinders 118 can be improved from ±250 um to less than ±5 um, providing for improved circuit element placement accuracy at each print station 106*a*, 108*a*, 108*b* and 108*c* and improved registration between the print stations 106*a*, 108*a*, 108*b* and 108*c*.

Thus, the main control system 103 can interact with the various print cylinder registration sensors 126 and the various material registration sensors 128 and then control the alignment and rotational speeds of the various print cylinders 118 to match the moving material 104 and accurately match/register the print cylinders 118 with circuit elements 102 already printed on the material 104. In one example, the main control system 103 has one or more processors 136 and at least one memory 138 (storage 138) that includes processor-executable instructions where the one or more processors 136 are adapted to interface with the memory 138 and execute the processor-executable instructions to interface with and control the various mechanical device(s) (variable speed drives-motors, alignment devices etc.) associated with the print cylinders 118 and possibly the pressure cylinders 120 to ensure that the position and rotational speed of each down-stream print cylinder 118 is matched to the moving material 114. The one or more processors 136 and the at least one memory 138 can be implemented, at least partially, as software, firmware, hardware, or hard-coded logic.

Figure 4:
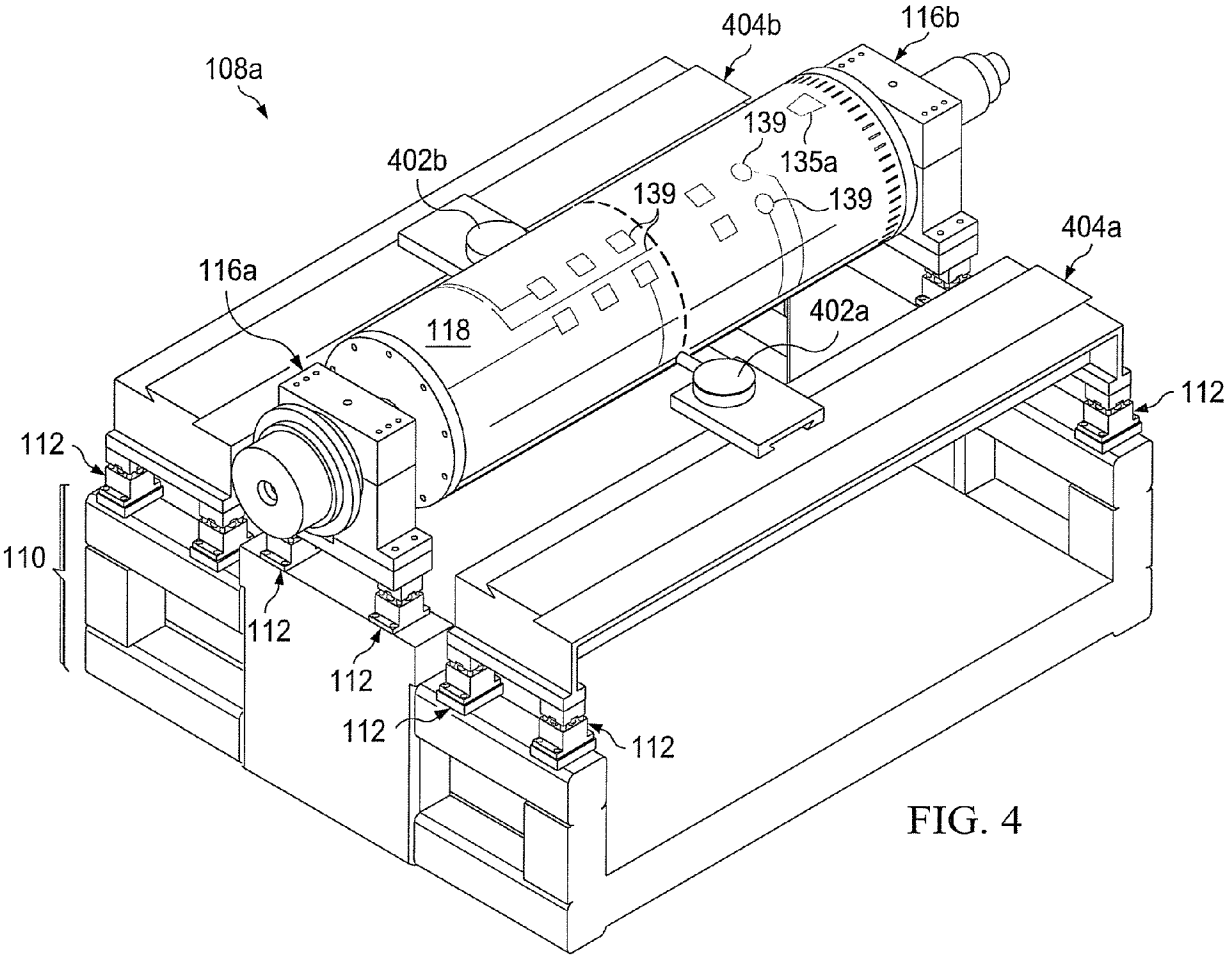
FIG. 4 is a perspective view of an exemplary print cylinder station which is used to help explain how the print cylinder and kinematic mounts can be aligned to one another by using one or more alignment indicators.

Referring to FIG. 4 there is shown a perspective view of an exemplary print cylinder station 108*a*, which is used to help explain how the print cylinder 118 and the kinematic mounts 112 can be aligned to one another by using one or more alignment indicators 402*a* and 402*b* (two shown) prior to the roller support platform 114*a*, the pressure cylinder 120, the pressure sensor 124, and other devices being added thereto. To perform the alignment operation, the print cylinder 118 is radially supported and balanced between the two bearings 116*a* and 116*b* each of which are mounted on multiple kinematic mounts 112. Plus, the alignment indicators 402*a* and 402*b* may be respectively mounted on alignment supports 404*a* and 404*b* each of which are mounted on multiple kinematic mounts 112. Then, the kinematic mounts 112 are all adjusted until the alignment indicators 402*a* and 402*b* remain in constant contact with the print cylinder 118 as the alignment indicators 402*a* and 402*b* are moved along the length of the rotating print cylinder 118. Thereafter, the alignment indicators 402*a* and 402*b* and their alignment supports 404*a* and 404*b* are removed and the roller support platform 114*a*, the doctor-blade system 114*b* and the other devices can be mounted with a high degree of accuracy onto the corresponding kinematic mounts 112.

Figure 5:
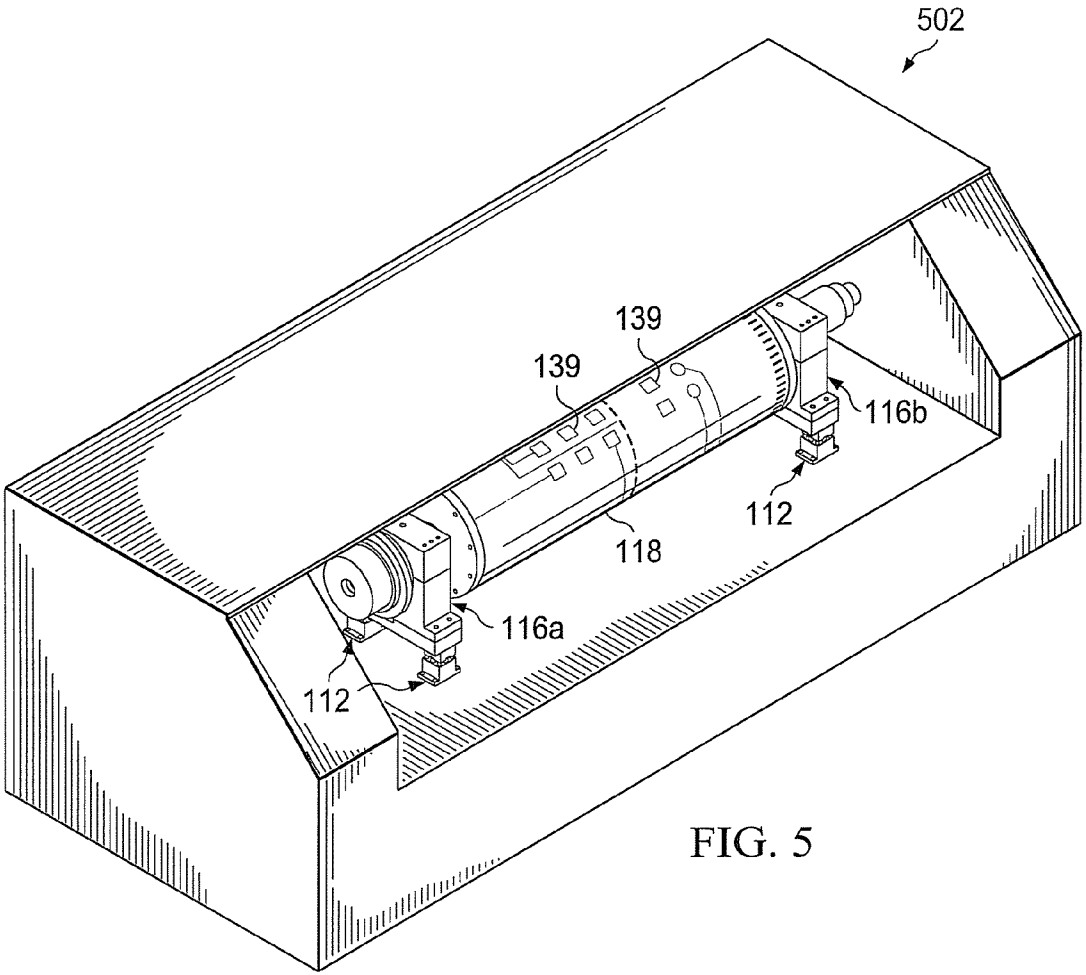
FIG. 5 is a perspective view of an exemplary engraving machine used to engrave the print cylinder used in the print cylinder station shown in FIGS. 2-3.

Referring to FIG. 5, there is shown a perspective view of an exemplary engraving machine 502 that can be used to engrave the print cylinder 118 in accordance with an embodiment of the present invention. To perform the engraving operation, the print cylinder 118 would first be balanced while being radially supported between the two bearings 116*a* and 116*b* (same ones to be used during the printing operation) and while the two bearings 116*a* and 116*b* are mounted on multiple kinematic mounts 112 (same ones to be used during the printing operation and in this example only the upper half of the kinematic mounts 112 that are connected to the cylinder bearing blocks would be the same.). The balanced print cylinder 118 along with the two bearings 116*a* and 116*b* and their corresponding kinematic mounts 112 are then placed within the engraving machine 502. Then, the engraving machine 502 engraves the desired configuration onto the print cylinder 118 while it is supported between the two bearings 116*a* and 116*b* and while the bearings 116*a* and 116*b* are supported by the kinematic mounts 112. The engraved print cylinder 118, the two bearings 116*a* and 116*b* and their corresponding kinematic mounts 112, are then removed as a unit from the engraving machine 502 and placed on the base 110 of the respective print cylinder station 106, 108*a*, 108*b* and 108*c*. Thereafter, the engraved print cylinder 118 are aligned with the other kinematic mounts 112 using the alignment indicators 402*a* and 402*b* as described above in FIG. 4. Lastly, the engraved print cylinder 118 may be used to print at least a portion of the electronic circuit 102 onto the material 104 as described above in FIG. 1.

This engraving process in which the print cylinder 118, the bearings 116*a* and 116*b* and the corresponding kinematic mounts 112 are all placed as a unit within the engraving device 502 and then moved as a unit and mounted within the print station 106*a*, 108*a*, 108*b* and 108*c* is a marked-improvement over the traditional engraving process where only the print cylinder 118 itself would be moved between bearings located within the engraving machine and different bearings located within the print station. In particular, this engraving process ensures minimal run-out variation between the engraving process and the print press process by preventing the creation of a wobble in the motion of the print cylinder 118 while it is used in printing operation that results from the print cylinder 118 being mounted in different bearings and on different mounts during printing than during engraved. In addition, this engraving process maximizes the print resolution, alignment and registration during the print process. Plus, this engraving process enables one to alternatively use ordinary mounts and not the specialized kinematic mounts 112 (e.g., exact constraint mounting features 112) if desired and still benefit from an improvement over the traditional engraving process. It is estimated by implementing this change to the engraving process that the maximum run-out can be improved from 25 um to less than 1 um.

In view of the foregoing discussion, it should be appreciated by those skilled in the art that the print press system 100 and the print cylinder stations 106, 108*a*, 108*b* and 108*c* address a need for improved performance in the current printing technology to enable printed electronic circuits 102 that require higher resolution to be manufactured in a continuous format on a material 104 (e.g., glass substrate 104, plastic film 104, plastic film-glass substrate laminate 104). In particular, the print press system 100 and the print cylinder stations 106, 108*a*, 108*b* and 108*c* can improve the print resolution and layer to layer registration of the different layers of the electronic circuit 102 from +125 μm to +25 μm which is desirable when printing electronic circuits 102 with small features on a material 104 in a continuous format. This improvement is made possible by one or more of the following features:

- Improved mechanical run-out of the print cylinders 118 caused by the stiffness of the print cylinder's bearings 116*a* and 116*b* which help to improve print location accuracy and the layer to layer registration and velocity control.
- Improved mechanical run-out of the relationship between the print cylinder 118 and the engraving process help to reduce the print line weight, thickness and width variation.
- The use of kinematic mounts 112 allow for more accurate and quicker alignment of the print cylinders 118 and associated devices.
- The use of a temperature control system 122 helps to maintain the print cylinders 118 and their associated ink systems (if desired) at a relatively uniform and stable thermal environment.
- The use of pressure sensors 124 help to monitor the real time pressure and force applied to the material 104 by the print cylinders 118 and the pressure cylinders 120 to reduce the print line weight, thickness and width variation.

Improved alignment and velocity control is made possible by engraving a reference scale (optional) and a trapezoid (or any shape with an angled edge) on the leading print cylinder 118, printing the reference scale 132 (optional) and the trapezoid 133 (or any shape with an angled edge) on the material 104. And, engraving a trapezoid 135*a* (or any shape with an angled edge) on the down-stream print cylinders 118 and printing the trapezoids 137*a* and 137*b* (or any shape with an angled edge) on the material 104. Plus, locating the material registration sensor 128 on each of the subsequent print cylinder stations 108*a*, 108*b* and 108*c*.

As described, the print cylinder stations 106, 108*a*, 108*b* and 108*c* can have one or more of the following features such as, the print cylinder's bearings 116*a* and 116*b*, the engraving of the print cylinder 118, the alignment of the print cylinders 118 and associated components, the temperature control of the print cylinders 118, the force measurement, and the ability to print a reference scale on the material 104, and the use of a scale for layer to layer alignment and synchronizing downstream print cylinders 118 to the match the moving material 104. In exemplary applications, the print press system 100 can be used to print an electronic circuit 102 on a material 104 (e.g., glass substrate 104, plastic film 104, plastic film-glass substrate laminate 104) to form, for instance, a flexible Liquid Crystal Display, a retail point of purchase sign and an e-book.

Although one embodiment of the present invention has been illustrated in the accompanying Drawings and described in the foregoing Detailed Description, it should be understood that the invention is not limited to the disclosed embodiment, but is capable of numerous rearrangements, modifications and substitutions without departing from the spirit of the invention as set forth and defined by the following claims. Plus, it should be appreciated that the reference to the "present invention" or "invention" used herein relates to exemplary embodiments and not necessarily to every embodiment that is encompassed by the appended claims.

The invention claimed is:

1. A method for printing an electronic circuit on a material, the method comprising the steps of:

setting-up a lead print cylinder station and at least one subsequent print cylinder station, where each print cylinder station includes:

a base;

a plurality of adjustable mounts located on the base;

at least one component, each component located on one or more of the adjustable mounts;

a pair of bearings, each bearing located on one or more of the adjustable mounts; and a print cylinder rotatably supported between the pair of bearings, wherein the one or more of the adjustable mounts associated with the pair of bearings and the one or more of the adjustable mounts associated with each component have been positioned to ensure that each component is substantially aligned with the print cylinder;

aligning the print cylinder in the lead print station and the print cylinder in the at least one subsequent print cylinder station next to one another such that the material is able to move from the lead print cylinder station to each subsequent print cylinder while the electronic circuit is printed on the material; and adjusting one or more of the adjustable mounts associated with the pair of bearings and adjusting one or more of the adjustable mounts associated with each component under control of a main control system to adjust an alignment of the print cylinder and to adjust an alignment of each component relative to the print cylinder and ensure that each component is substantially aligned with the print cylinder, further comprising a step of engraving at least one of the print cylinders within an engraving machine while the print cylinder is rotatably supported between the pair of bearings and the pair of bearings are supported by the one or more adjustable mounts;

removing the at least one of the print cylinders and the pair of bearings from the engraving station as a unit; and mounting the at least one of the print cylinders and the pair of bearings as a unit in a corresponding one of the lead print station and at least one subsequent print cylinder station on a corresponding one of the plurality of adjustable mounts.

2. The method of claim 1, wherein the:

the lead print cylinder station further includes a pressure cylinder associated with the print cylinder such that the material is able to be drawn between both the pressure cylinder and the print cylinder; and each subsequent print cylinder station further includes a pressure cylinder associated with the print cylinder such that the material is able to be drawn between both the pressure cylinder and the print cylinder.

3. The method of claim 2, further comprising a step of monitoring a force applied by at least one of the print cylinders and the corresponding pressure cylinder on the material where the measured force is used to control a nip force between the print cylinder and the corresponding pressure cylinder while at least part of the electronic circuit is printed on the material.

4. The method of claim 1, further comprising a step of aligning at least one of the print cylinders using an alignment indicator which is mounted to one of the at least one component, where the at least one of the print cylinders is aligned when the alignment indicator has constant contact with the corresponding print cylinder while the alignment indicator is moved along a length of the corresponding rotating print cylinder.

5. The method of claim 1, further comprising the steps of:

using the lead print cylinder station to print registration lines and an angled shaped structure onto the material;

using each subsequent print cylinder station to print an angled shaped structure onto the material;

using each subsequent print cylinder station to monitor the registration lines and the one or more angled shaped structures printed on the material and to monitor registration lines engraved on the corresponding print cylinders; and using the monitored registration lines and the monitored angled shaped structures printed on the material and the monitored registrations lines engraved on the corresponding print cylinders to adjust at least one print cylinder associated with at least one of the at least one subsequent print cylinder station to match the moving material.

6. The method of claim 1, further comprising a step of controlling a temperature of at least one of the print cylinders while the electronic circuit is printed on the material.

7. The method of claim 1, wherein each bearing is a hydrostatic bearing or an air bearing and the method further comprises the steps of:

aligning at least one of the print cylinders using an alignment indicator which is mounted to one of the at least one component, where the at least one of the print cylinders is aligned when the alignment indicator has constant contact with the corresponding print cylinder while the alignment indicator is moved along a length of the corresponding rotating print cylinder;

using the lead print cylinder station to print registration lines and an angled shaped structure onto the material;

using each subsequent print cylinder station to print an angled shaped structure onto the material;

using each subsequent print cylinder station to monitor the registration lines and the one or more angled shaped structures printed on the material and to monitor registration lines engraved on the corresponding print cylinders; and using the monitored registration lines and the monitored angled shaped structures printed on the material and the monitored registrations lines engraved on the corresponding print cylinders to adjust at least one print cylinder associated with at least one of the at least one subsequent print cylinder station to match the moving material.

8. A method of preparing a print cylinder comprising the steps of:

positioning a unit relative to an engraving machine, wherein the unit includes a pair of bearings and a print cylinder rotatably supported between the pair of bearings;

engraving a desired configuration on the print cylinder with the engraving machine;

removing the unit from the engraving machine; and mounting the unit on a base of a printing machine.

9. The method of claim 8, wherein the step of positioning further includes supporting the bearings and the print cylinder as a unit in the engraving machine on adjustable mounts that align the print cylinder with the engraving machine; and wherein the step of mounting includes supporting the bearings as a unit in the printing machine on the adjustable mounts that align the print cylinder with the printing machine.

10. The method of claim 8, wherein each bearing is a hydrostatic bearing or an air bearing and wherein the step of engraving includes engraving registration lines, an angled shaped structure, and an electronic circuit on the print cylinder.

* * * * *